United States Patent [19]

Lemelson

[11] 4,155,185

[45] May 22, 1979

[54] TWO PART SIGN INDICIA

[76] Inventor: Jerome H. Lemelson, 85 Rector St., Metuchen, N.J. 08840

[21] Appl. No.: 825,700

[22] Filed: Aug. 18, 1977

[51] Int. Cl.[2] ..... G09F 7/00

[52] U.S. Cl. ..... 40/623; 40/618; 40/596

[58] Field of Search ..... 40/623, 618, 144, 596; 63/2

[56] References Cited

U.S. PATENT DOCUMENTS

| | | | |
|---|---|---|---|
| 1,009,893 | 11/1911 | Carter | 40/623 |
| 1,129,019 | 2/1915 | Rooney | 40/623 |
| 1,371,925 | 3/1921 | Morgenthaler | 40/623 |
| 2,399,029 | 4/1946 | Hoag | 40/623 |
| 2,534,467 | 12/1950 | Miller | 40/618 |

FOREIGN PATENT DOCUMENTS

| | | | |
|---|---|---|---|
| 1177403 | 12/1958 | France | 40/623 |

*Primary Examiner*—Louis G. Mancene
*Assistant Examiner*—Wenceslao J. Contreras

[57] ABSTRACT

Constructions are provided in molded indicia such as letters and numbers which may be easily assembled together to form words and other formations. Individual moldings in the shape of alphabetical and/or numerical characters are each provided with a plurality of through openings extending in either the horizontal or vertical directions permitting the moldings to be assembled against a rod, wire or elongated flexible member or members to form assemblies representative of words or other intelligence.

In a preferred form, each molding is composed of two half parts or formations which, when properly assembled, represent a particular alphabetical or numerical character. The formations frictionally or otherwise assembled together to form the character are each shaped with a rim which either snap assembles over a rod, tube, strip or string or contains indented portions along the rim which compressibly engage said rod, strip, tube or string to retain the molding against that portion thereof which it engages.

In another form, the portions of each molding are hingedly molded together so that the molding may be easily assembled in alignment with an elongated member such as a rod, strip, tube or string.

In a particular further embodiment, the elongated member comprises one or more electrical conductors and light emitting means such as an electric lamp are connected thereto and enclosable within to provide internally lighted characters.

10 Claims, 10 Drawing Figures

TWO PART SIGN INDICIA

SUMMARY OF THE INVENTION

This invention relates to improvements in characters such as alphabetical and numerical characters formed by molding or casting materials such as plastic resins. In particular, the invention is concerned with improvements in the structures of molded characters which are shaped to permit them to be assembled to form words, sentences and the like wherein the assembly is effected by means of a common member such as a wire, rod, string or tube, or a plurality of such members, which may be employed to hang or join the alphabetical characters and/or numbers thereto.

Educational toys are known in the art which employ letters and numbers which are secured together or held in arrays such as assemblies or arrangements thereof to form words or other information defining arrays. Such arrays or assemblies have been formed by means of magnets secured to the characters and attracted to a paramagnetic board such as one made of sheet steel or by holding the letters and numbers in receptacles by means of gravity. Most of these techniques are relatively complex to effect assembly of the letters and may employ relatively expensive joining components.

The instant invention is directed to improvements in the construction of letters and numbers made of plastic resin and the shapes thereof are such as to easily accommodate each letter either in a hanging attitude or in clamping engagement against a rod, tube or strip supporting enough of such characters to permit them to form one or more words thereof. In one form of the instant invention, the letters or numbers are peripherally molded with a plurality of cavities in opposite portions thereof and, upon assembly of the opposite portions, are made to frictionally grip a wire, rod or tube to permit them to hang vertically thereon or in a horizontal manner depending on how the display is desired to be completed.

Accordingly, it is a primary object of this invention to provide new and improved structures in molded letters and numbers as well as other configurations together with means for assembling and retaining such characters in a fixed assembly.

Another object is to provide a new and improved educational toy in which letters and numbers may be easily arrayed in either the horizontal direction or vertical direction and retained in such array to form words thereof and to permit a child to hang or otherwise support the array of letters or numbers.

Another object is to provide new and improved structures in letters and characters which may be easily assembled to form words and which may be electrically energized and illuminated.

Another object is to provide an assembly toy which is interesting to a child to assemble and which is relatively simple to effect such assembly.

With the above and such other objects in view as may hereafter more fully appear, the invention consists of the novel constructions, combinations and arrangements of parts, as will be evident from the accompanying drawings and Specification, but it is to be understood that changes and modifications may be restored to which come within the scope of the invention as claimed without departing from the spirit and nature of the invention.

With the above and such other objects in view as may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

Figure 2:
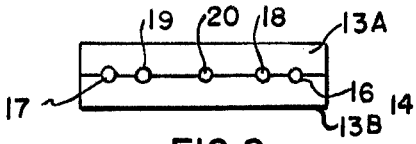
FIG. 2 is a top view of one of the characters of FIG. 1.
Figure 1:
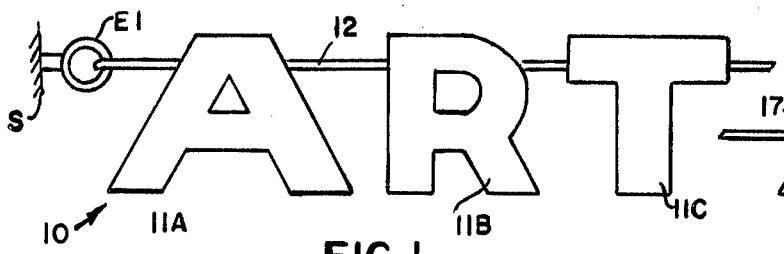
FIG. 1 is a side view of a plurality of characters in the shapes of alphabetical letters which are assembled in a horizontal array or row against an elongated member such as a flexible filament which is shown secured in a horizontal attitude and holding the characters together.
Figure 3:
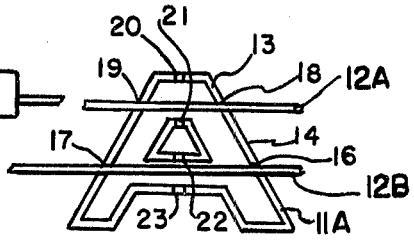
FIG. 3 is a side view showing the interior of one of the characters of FIG. 1.

There is shown in FIGS. 1–3 a first configuration of the instant invention which is composed of an assembly 10 of a plurality of alphabetically shaped characters denoted 11A, 11B, 11C, which respectively represent the letters ART which are shown assembled to an elongated member 12 and held in a string-like array thereby. The elongated member 12 may comprise conventional cotton thread or string, solid rigid or flexible plastic rod or tubing, metal wires or cable or wooden dowel. It is shown as being secured at one end to a retaining ring E1 which is retained by a base or screw to a wall or component S of any suitable support such as a frame comprising part of the toy or display. The other end of member 12 may be similarly secured to another portion of the frame or support for the toy or display.

In the component configuration of FIGS. 1–3, each of the character components is formed of two parts, a front part 13A and a rear part 13B. While each of these parts may be molded or otherwise formed in respective solid shapes, they are illustrated in FIGS. 1 and 3 as each having respective outer wall portions, which portions are denoted 14A and 14B and respective circumscribing side wall portions which are respectively denoted 15A and 15B for the respective character components.

For toy components in the shape of characters which vary from about one-half inch to two inches in maximum dimension, the side wall portions of each character or letter may extend between 1/16" to ¼" or more from the side wall portions 14A and 14B and are preferably configured to conform to each other so that the edges thereof may abut each other and may be clampingly engaged against the elongated member 12 as will be described. While not illustrated in FIG. 3, the edges of the side walls of each portion of each letter or character may be shaped to frictionally secure to or snap assemble with the edges of the corresponding mating portion of the character to provide simple assembly means which will hold closed yet may be opened by prying the two parts apart.

Figure 7:
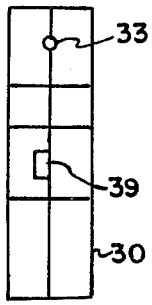
FIG. 7 is an end view of the article of FIG. 6 with the portions thereof closed against each other.

The letter A illustrated in FIGS. 2 and 3 is shown having at least eight notches or indentations formed therein at different locations to accommodate a plurality of elongated members, two of which, denoted 12A and 12B, are illustrated as extending laterally across the character for not only positionally locating same but also retaining it in a fixed attitude with respect to the two elongated rod-like members. Rod member or string 12A passes through openings in the opposite edge walls of the assembled character defined by cavities 18 and 19 which respectively are aligned with similar cavities in the edge wall of the opposite character member 13B as shown in FIG. 7. Rod member or string 12B extends laterally across the middle portion of the character through notches or indentations 16 and 17 formed in the respective opposite side walls of the character member 13. Both rod members are frictionally held between those portions of the edges of the side walls of the two character members 12 and 13 which are notched or indented, as illustrated in FIG. 2 at the locations denoted 16–19.

Figure 5:
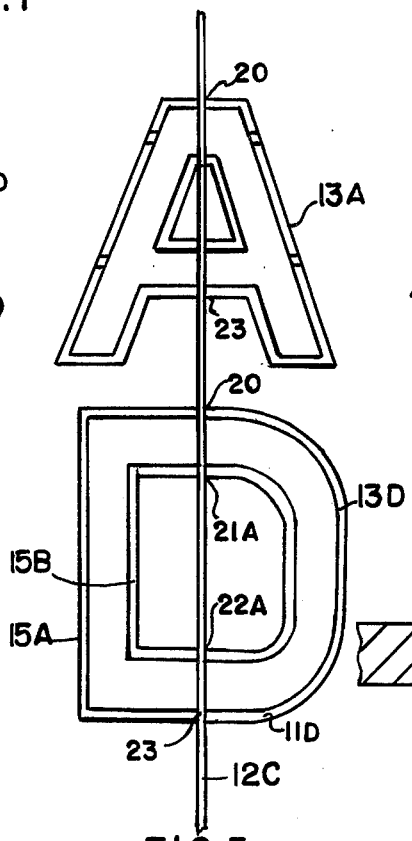
FIG. 5 is a side view showing two alphabetical characters assembled against an elongated member and disposed one above the other.

Notches 20, 21, 22 and 23 are formed in the horizontal portions of the character defined by the upper edge wall of letter A, the edge walls of the opening in the letter A and the lower edge wall between the legs of the letter. Thus, if a rod member or string is extended vertically through the indentations or notches 20–23, the character may be supported in a vertical attitude as illustrated in FIG. 5. In other words, in a preferred form of the invention, each character or article to be assembled on a string or rod is formed of at least two components of similar configuration, such as the front and rear components 13A and 13B shown in FIG. 2 which components are adapted to be frictionally or otherwise assembled together against one or two string-like members or rods which extend either vertically or horizontally through the components to provide either a vertical or a horizontal array of the components for forming words, arrays of words or sentences.

Figure 4:
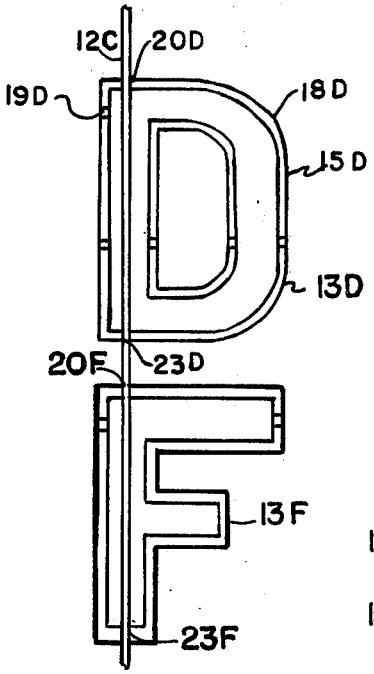
FIG. 4 is a side view showing portions of the interiors of two alphabetical characters disposed one above the other on an elongated string or rod.

In FIG. 4, the rear portions of two characters 13D and 13F are shown vertically aligned with each other with a rod or string 12C extending through the cavities defined by the left hand portions of the characters and engaged by indentations or notches denoted 20D, 23D, and 20F, 23F which are formed in the upper and lower edge walls of the respective members 13D and 13F. Mating letter formations of similar configuration are thereafter secured to the formations 13D and 13F by snap-assembly of the edge portions of each, by means of suitable fasteners [not shown] or by adhesive or solvent bonding.

In FIG. 5, parts 13A and 13D for the letters A and D, are shown having a rod or string 12D extending vertically and nesting in notches in the respective wall portions which are aligned therewith permitting the respective mating portions of said characters to be frictionally or snap-assembled thereto over the elongated member to hold the assembled characters in place. Notations 20D, 21D,22D and 23D refer to indented portions or notches formed in the respective horizontal edge walls of the character component 13D to receive and accommodate the vertical string or rod member 12D.

The character component 11D of FIG. 5 is shown having the inner edges of the side wall 15A and 15B thereof stepped in shape so as to permit frictional engagement with the mated matched stepped portion of the other D-shaped character portion which assembles thereto against the rod or string member 12C in a manner similar to that in which a two-piece plastic box has its components snap-assembled and frictionally retained together.

Figure 6:
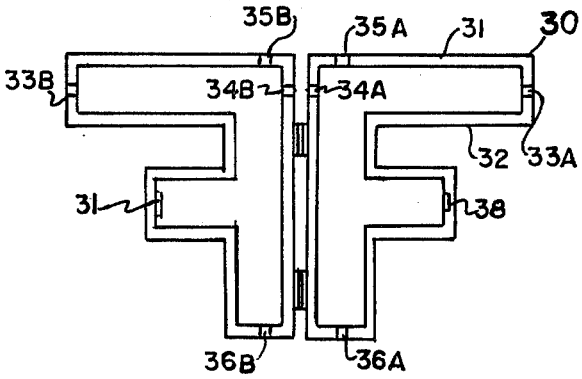
FIG. 6 is a side view of a character of the type shown in FIG. 4 and composed of front and rear portions which are illustrated opened and integrally molded together along hinge portions permitting them to be closed against each other and against one or more elongated members.

In FIGS. 6 and 7 is shown a modified form of construction for a character shaped article denoted 30 composed of two portions 31A and 31B which are integrally molded together by means of respective hinge portions 39A and 39B joining the two and permitting them to be pivoted with respect to each other from the open condition illustrated in FIG. 6 to the closed condition as shown in FIG. 7 to form a hollow body thereof. The portions 31A and 31B are in the configuration of an F which contains three pairs of aligned holes formed of respective molded notches or cavities in the top and bottom edge walls and the side edge walls of the assembled character. Notches 33A and 33B respectively form a hole through the far end wall of the upper leg of the character while notches 34A and 34B respectively form a second hole aligned with the hole defined by notches 33A and 33B, in the opposite end of the upper leg of the character to permit a string or rod to pass through the upper leg of the character and be clampingly engaged by the surfaces of the respective notch formations. Notch formations 36A and 36B are formed in the respective outer edge walls of the vertical leg of the character. Notch formations 37A and 37B are formed in the respective inner edge walls of the vertical leg of the character aligned with the notch formations 36A and 36B for clampingly engaging a string or rod extending horizontally through the vertical leg when the character portions 31A and 31B are assembled.

Notch formations 35A and 35B are formed in the upper edge walls of the upper leg of the character and provide a hole through the assembled character aligned with the second hole in the lower edge walls of the vertical leg defined by notch formations 36A and 36B permitting a string or rod to extend vertically through the vertical leg of the character. Notations 38 and 39 refer to respective lip and receptacle formations provided inwardly of the outer edge walls of the lower horizontal leg of the character and are shaped to deflect and frictionally engage together when the character portions 31A and 31B are pivoted and secured together. Molding 30 of FIGS. 6 and 7 is preferably made of a suitable deflectable plastic material such as medium or high density polyethylene or polypropylene.

Figure 8:
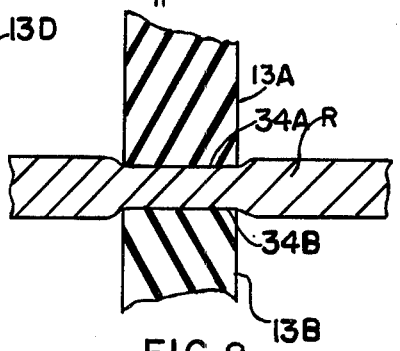
FIG. 8 is a cross-sectional view of a fragment of a character and a flexible member passing through an opening defined between openable portions of the character.

In FIG. 8 is shown a cross-sectional view of the edge walls of matched character forming portions 13A and 13B taken at the notched formations 34A and 34B thereof which, upon frictional assembly of the portions 31A and 31B, compressibly engage the flexible rod or string R and deform same as illustrated to frictionally retain the assembly thereagainst.

Figure 9:
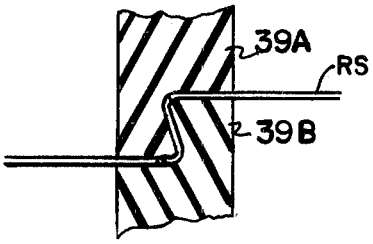
FIG. 9 is an end cross-sectional view of a fragment of a modified form of character of the type described and a strip member frictionally assembled therewith for holding the character thereon.

In FIG. 9 is shown a configuration for the described edge walls of a character formed of portions 39A and 39B, each of which edge walls is stepped in shape as illustrated and thereby provides frictional engagement with a thread or flat strip flexible member RS which extends along the stepped portions of the assembled character portions as illustrated.

Figure 10:
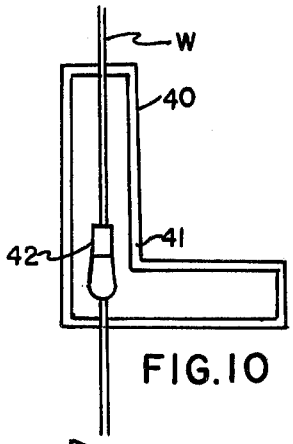
FIG. 10 is a side view of one portion of an alphabetical character containing a wire pair extending vertically therethrough and a small electric lamp disposed therein for lighting the character.

In FIG. 10 is shown a character component 40 of the type described having a wire W extending through the vertical leg thereof and a small light bulb 42 secured to the wire within the confines of the character portion for eliminating same from the interior thereof when electrical energy is applied to the lamp through the wires W.

While the embodiments of the assembly toy or display illustrated in FIGS. 1–5 and 6–7 are preferred forms of the invention, it is noted that a number of variations in the shape and assembly means illustrated may be resorted to without departing from the spirit and nature of the invention. For example, the wires or rods illustrated may be assembled to the backs of a plurality of character shaped articles by means of plug-like formations which frictionally assemble in openings or against protruding portions of the molded characters to retain the characters in the spaced relationship with each other along the elongated member.

I claim:

1. An assembly toy comprising in combination:

a plurality of first members each having first and second portions configured to be assembled and retained together in a configuration representative of a respective character, an elongated support member, means for disposing said first and second portions of each of said first members against and around said elongated support, means for securing the first and second portions of a first of said first members around a selected portion of said elongated support for retaining said first member in assembly with said elongated support, means for similarly supporting a plurality of similarly assembled further first members at different locations on said elongated support to provide a string of characters thereof and means for supporting said elongated support at at least one end thereof to support said plurality of first members assembled on said elongated support in a row.

2. An assembly in accordance with claim 1 wherein said first and second portions of each of said first members are each shaped in the configuration of a character, one being the mirror image configuration of the other.

3. An assembly in accordance with claim 2 including means for frictionally assembling said first and second portions of each of said first members to each other whereby they will be retained in assembly on said elongated member and yet may be pried apart for disassembly therefrom.

4. An assembly in accordance with claim 3 wherein the frictional assembly means for said first and second portions of each of said first members comprises respective shaped portions of said first and second portions of said first members which are configured to snap-assemble together when said first and second members are matchedly aligned with each other.

5. An assembly in accordance with claim 4 wherein the border portions of said first and second portions of each of said first members contain respective overlapping portions at least one of which overlapping portions is adapted to deform over and around the other when compressed against the other during the assembly of the first and second portions together.

6. An assembly in accordance with claim 1 wherein said first and second portions of each of said first members are hingedly joined together and are shaped to frictionally snap-assemble when pivoted into alignment and compressed against each other.

7. An assembly in accordance with claim 1 wherein said first and second portions of each of said first members are both part of a single molding and are joined to each other by a molded hinge portion.

8. An assembly in accordance with claim 1 wherein at least one of said first and second portions of each of said first members contains a side wall and a circumscribing edge wall joined to said side wall, said elongated member adapted to be disposed along said edge wall and to be compressibly engaged thereby when said first and second portions of said first member are aligned and compressed together.

9. An assembly in accordance with claim 8 including an indentation in the edge wall of said one portion of said first member, said indentation being configured to conform to the surface shape of a portion of said elongated member.

10. An assembly in accordance with claim 1 wherein both said first and second portions of each of said first members contain outwardly facing side walls and respective edge walls joined to their respective side walls which edge walls define respective rims which are configured and adapted to match and to be abutted with each other upon assembly of the first member.

* * * * *